US009932819B2

(12) United States Patent
Blangé et al.

(10) Patent No.: US 9,932,819 B2
(45) Date of Patent: Apr. 3, 2018

(54) METHOD OF ORIENTING A SECOND BOREHOLE RELATIVE TO A FIRST BOREHOLE

(71) Applicant: SHELL OIL COMPANY, Houston, TX (US)

(72) Inventors: Jan-Jette Blangé, Rijswijk (NL); Koen Antoine Noy, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 498 days.

(21) Appl. No.: 14/428,557

(22) PCT Filed: Sep. 16, 2013

(86) PCT No.: PCT/EP2013/069100
§ 371 (c)(1),
(2) Date: Mar. 16, 2015

(87) PCT Pub. No.: WO2014/044628
PCT Pub. Date: Mar. 27, 2014

(65) Prior Publication Data

US 2015/0240623 A1 Aug. 27, 2015

(30) Foreign Application Priority Data

Sep. 18, 2012 (EP) ..... 12184829

(51) Int. Cl.
*E21B 47/022* (2012.01)
*E21B 7/04* (2006.01)

(52) U.S. Cl.
CPC ..... *E21B 47/02216* (2013.01); *E21B 7/04* (2013.01)

(58) Field of Classification Search
CPC ..... E21B 47/022; E21B 47/02216; E21B 47/024; E21B 47/12; E21B 7/04
See application file for complete search history.

(56) References Cited

U.S. PATENT DOCUMENTS 3,725,777 A 4/1973 Robinson et al.
5,064,006 A * 11/1991 Waters ..... E21B 7/068 175/45

(Continued)

FOREIGN PATENT DOCUMENTS

EP 301671 2/1989

OTHER PUBLICATIONS

PCT International Search Report, Application No. PCT/EP2013/069100 dated Jan. 3, 2014.

*Primary Examiner* — Jaehwan Oh

(57) ABSTRACT

A method for creating a second borehole in an earth formation at a selected orientation relative to a first borehole, wherein a position parameter represents a position of the first borehole. The method comprises: a) providing a borehole element that generates a magnetic field; b) measuring the magnetic field; c) installing the borehole element in the first borehole; d) measuring the magnetic field in the second borehole; e) providing a finite element model of the magnetic field; f) calculating the magnetic field in the second borehole using the finite element model, and determining a difference between the calculated magnetic field in the second borehole and the measured magnetic field in the second borehole; g) adjusting the position parameter so as to minimize said difference; and h) determining a selected direction dependent on the adjusted position parameter and further drilling the second borehole in the selected direction.

25 Claims, 5 Drawing Sheets

(56) References Cited

U.S. PATENT DOCUMENTS

Figure 1:
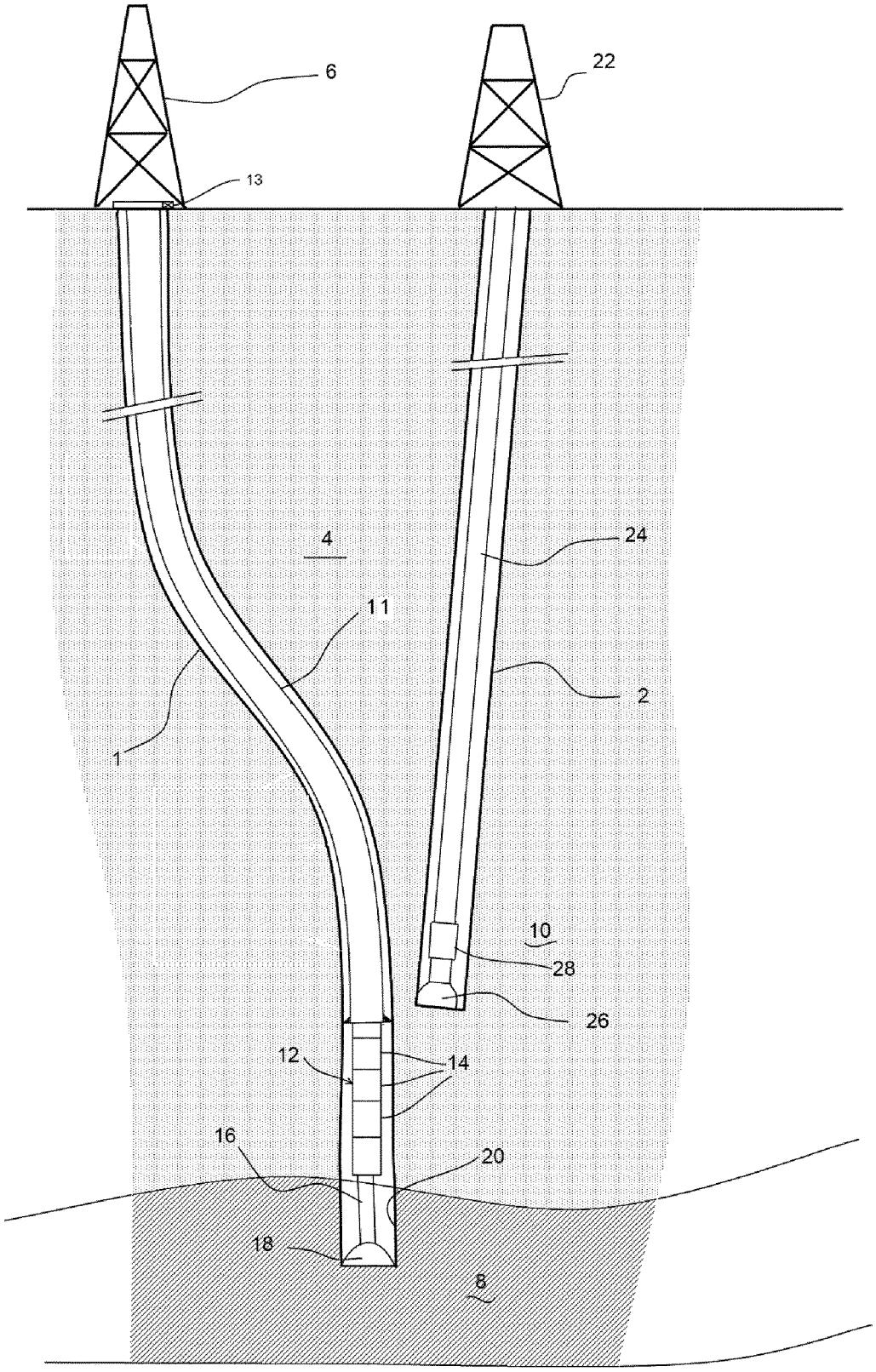

| | | | | |
|---|---|---|---|---|
| 5,230,387 | A * | 7/1993 | Waters | E21B 7/068 175/45 |
| 2002/0060570 | A1* | 5/2002 | Shirasaka | E21B 47/022 324/338 |
| 2002/0112856 | A1* | 8/2002 | Van Steenwyk | E21B 47/02216 166/255.1 |
| 2004/0134081 | A1* | 7/2004 | Russell | E21B 47/022 33/304 |
| 2006/0131013 | A1* | 6/2006 | McElhinney | E21B 47/02216 166/250.01 |
| 2008/0000686 | A1* | 1/2008 | Kuckes | E21B 47/02216 175/24 |
| 2008/0275648 | A1* | 11/2008 | Illfelder | E21B 47/022 702/7 |
| 2009/0173504 | A1 | 7/2009 | McElhinney et al. | |
| 2010/0013487 | A1* | 1/2010 | Bloemenkamp | G01V 3/24 324/367 |
| 2012/0139530 | A1* | 6/2012 | McElhinney | E21B 47/02216 324/207.13 |
| 2012/0193144 | A1* | 8/2012 | Hallundbæk | E21B 7/04 175/45 |
| 2012/0298420 | A1* | 11/2012 | Seydoux | E21B 47/02 175/26 |
| 2013/0032404 | A1* | 2/2013 | Donderici | E21B 47/024 175/45 |

* cited by examiner

METHOD OF ORIENTING A SECOND BOREHOLE RELATIVE TO A FIRST BOREHOLE

The present invention relates to a method of creating a second borehole in an earth formation at a selected orientation relative to a first borehole formed in the earth formation. If, for example, the first borehole is a well for the production of hydrocarbon oil and/or gas it can be required to drill the second borehole to intersect the first borehole at a lower end part thereof. This may be the case if due to an incident control of the hydrocarbon well is lost, whereby an uncontrolled hazardous hydrocarbon release to seabed or surface may result. When the uncontrolled flow cannot be stopped at seabed or at surface, a last resort is to drill a relief well in order to stop flow. The objective of the relief well is to provide fluid communication with the target well above the reservoir, and to pump a heavy fluid via the relief well into the blowout well to stop the uncontrolled hydrocarbon fluid flow.

Due to some uncertainty in the positions of both the hydrocarbon well (hereinafter also referred to as "target well") and the relief well, it is not feasible to directly drill the relief well into the target well at depths that may range from 1000 m to 6000 m below the surface or sea-level. Such well position uncertainty is generally caused by instrument errors and/or operational errors while using the survey tools to determine the position of a well.

A proven successful relative positioning technique, referred to as Active Ranging, is based on the principle of generating an alternating current (AC) in the target well by injecting a current in the open hole of the nearby relief well. The AC starts flowing inside the steel material of the target well, the steel material either being a casing, a drill-pipe or both. The resulting magnetic field of the AC in the target well can then be measured in the relief well to determine the relative distance (RD) between the two wells and the high-side to target direction (HSTD) from the relief well to the target well. These parameters are then used to directionally steer the relief well into the target well and thereby to make fluid communication between the two wells. However, locating a target well from a relief well in a thick subsurface salt layer, Active Ranging is not feasible as the Salt layer will not conduct electric current. An AC cannot be generated in the target well, and therefore no alternating magnetic field can be measured in the relief well. In view thereof RD and HSTD cannot be measured, and the relief well cannot be accurately navigated into the target well.

U.S. Pat. No. 3,725,777 discloses a method of determining a relative position between a first well and a second well, whereby the first well is provided with a magnetized casing. The resulting magnetic field components are calculated as a function of the radial distance from the casing. Also the magnetic field is measured in the second well. The distance and direction between the wells is determined from a comparison between the calculated magnetic field and the measured magnetic field.

It is an object of the invention to provide an improved method to direct a second borehole towards a first borehole.

According to the invention, a method of creating a second borehole in an earth formation at a selected orientation relative to a first borehole formed in the earth formation, wherein a position parameter represents a position of the first borehole, comprises the steps of:

a) providing a borehole element that generates a magnetic field and is adapted to be arranged in the first borehole;

b) measuring at least one component of the magnetic field at a selected distance from the borehole element;

c) installing the borehole element in the first borehole;

d) measuring the magnetic field in the second borehole using magnetometer means;

e) providing a finite element model of the magnetic field using each component of the magnetic field measured in step (b) as a boundary condition for the finite element model;

f) calculating the magnetic field in the second borehole using the finite element model, and determining a difference between the calculated magnetic field in the second borehole and the measured magnetic field in the second borehole;

g) adjusting the position parameter so as to minimise said difference;

h) determining a selected direction dependent on the adjusted position parameter; and i) drilling the second borehole in the selected direction.

With the method of the invention it is achieved that the HSTD direction and the RD between the two boreholes are determined more accurately than in the analytical methods used in the prior art. Notably, in the method of the invention, the magnetic field is measured at said selected distance from the borehole element, which measurement is then used in the finite element model to calculate the magnetic field in the second borehole. It is thereby taken into account that each magnetic pole of the magnetized borehole element has a spatial distribution i.e. the pole is distributed along a certain length of the borehole element. This is contrary to the prior art in which it is assumed that each magnetic pole is concentrated at a discrete point.

Suitably the borehole element comprises a casing to be installed in the first borehole, and step (a) comprises magnetizing the casing so that the magnetic field is a static magnetic field. For example, if the casing is formed of a plurality of casing joints the step of magnetizing the casing comprises magnetizing each casing joint. Suitably each casing joint is magnetized so as to have magnetic poles mutually spaced in longitudinal direction of the casing joint. This technique is also referred to as passive magnetic ranging (PMR). PMR is based on the principle of magnetizing series of casing joints individually and longitudinally prior to running the casing joints (usually production casing joints) into the target well.

In order to provide a strong magnetic field, it is preferred that the casing joints include first and second casing joints interconnected in a manner that the magnetic fields of the first and second casing joints strengthen each other. Suitably the first and second casing joints have magnetic poles of similar polarity, wherein the first and second casing joints are interconnected so that said magnetic poles of similar polarity are adjacent each other.

To obtain accurate measurements of the magnetic field, it is preferred that step (b) comprises measuring each component of the magnetic field at said selected distance prior to installing the borehole element in the first borehole.

In a preferred embodiment, the borehole element has a substantially tubular shape, and wherein each component of the magnetic field is measured using an annular device comprising a magnetometer whereby the borehole element is moved in axial direction through the annular device. In a practical arrangement, the annular device is arranged above the first borehole, and the borehole element is lowered substantially vertically into the first borehole via the annular device. Suitably, the annular device is arranged at a drilling rig used to drill the first borehole. Furthermore, each component of the magnetic field is preferably measured at a plurality of axially spaced locations of the borehole element.

In order to provide an accurate boundary condition for the finite element model, the annular device suitably extends at a relatively short radial distance from the borehole element, for example at a distance of about 1 inch (25.4 mm).

Suitably the magnetic field is rotationally symmetric relative to a longitudinal axis of the borehole element, and the finite element model is a two-dimensional model involving an axial direction of the borehole element and a radial direction of the borehole element. The radial component of the magnetic field provides a good indication of the magnetic pole strength for each axial position, therefore suitably step (b) comprises measuring the radial component of the magnetic field. To improve the accuracy of the method, step (b) preferably further comprises measuring an axial component of the magnetic field. A tangential component of the magnetic field should be absent for the rotationally symmetrical magnetic field. Therefore, in order to check whether the quality of the measurement is adequate and/or to check whether the calibration for magnetic interference has been done properly, a measurement in tangential direction also may be conducted.

Step (d) of the method of the invention suitably comprises measuring the magnetic field in the second borehole using an electronic multi shot system.

Step (f) of the method of the invention suitably comprises calculating the magnetic field in a coordinate system characterized by an inclination angle and/or an azimuth angle of the second borehole. Further, said calculation suitably also takes into account an inclination angle and/or an azimuth angle of the first borehole.

Preferably step (h) of the method of the invention comprises determining a high-side-to-target direction from the second borehole to the first borehole. More preferably, step (h) also comprises determining a relative distance between the second borehole and the first borehole.

The method of the invention is particularly attractive in applications whereby the first borehole extends through a salt layer of the earth formation. Namely, in such applications the casing generally cannot be magnetized by injecting a current into the second borehole.

If the first borehole is a hydrocarbon well subjected to a blowout, the second borehole suitably is a relief well drilled to intersect the hydrocarbon well.

It is preferred that in at least one of steps (b) and (d) the measurement result is corrected for magnetic interference from a source other than the borehole element. Such interference may be due to, for example, the earth magnetic field or a magnetized drill string.

The invention also relates to a system for creating a second borehole in an earth formation at a selected orientation relative to a first borehole formed in the earth formation, wherein a position parameter represents a position of the first borehole, the system comprising:

- a borehole element that generates a magnetic field and is adapted to be arranged in the first borehole;
- a device for measuring at least one component of the magnetic field at a selected distance from the borehole element;
- installation means for installing the borehole element in the first borehole;
- magnetometer means for measuring the magnetic field in the second borehole;
- a finite element model of the magnetic field wherein said characteristic of the magnetic field is a boundary condition for the finite element model;
- calculating means for calculating the magnetic field in the second borehole using the finite element model, for determining a difference between the calculated magnetic field in the second borehole and the measured magnetic field in the second borehole, for adjusting the position parameter so as to minimise said difference, and for determining a selected direction dependent on the adjusted position parameter; and
- a drilling device for further drilling the second borehole in the selected direction.

Figure 2:
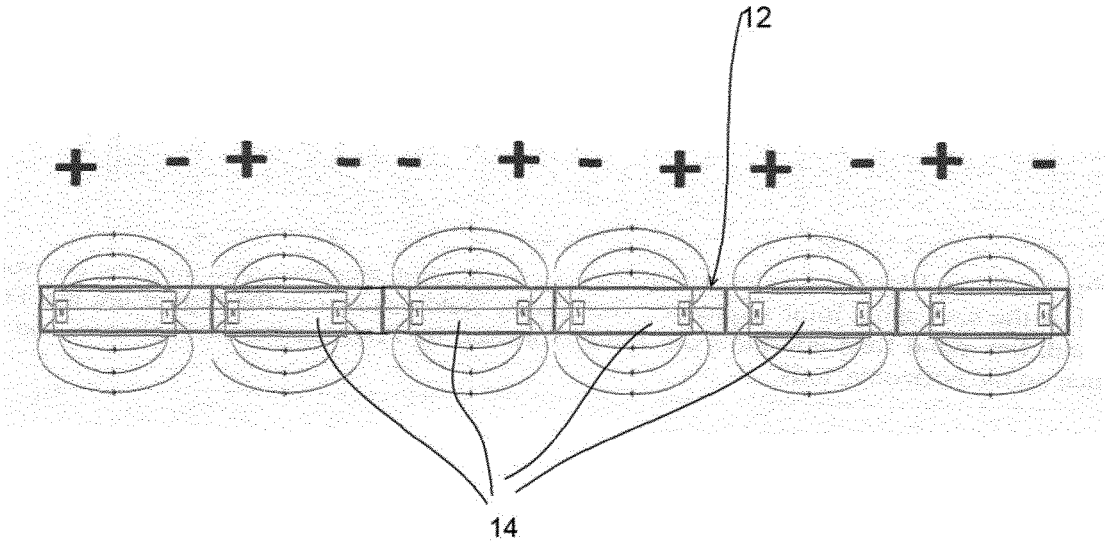
Figure 3:
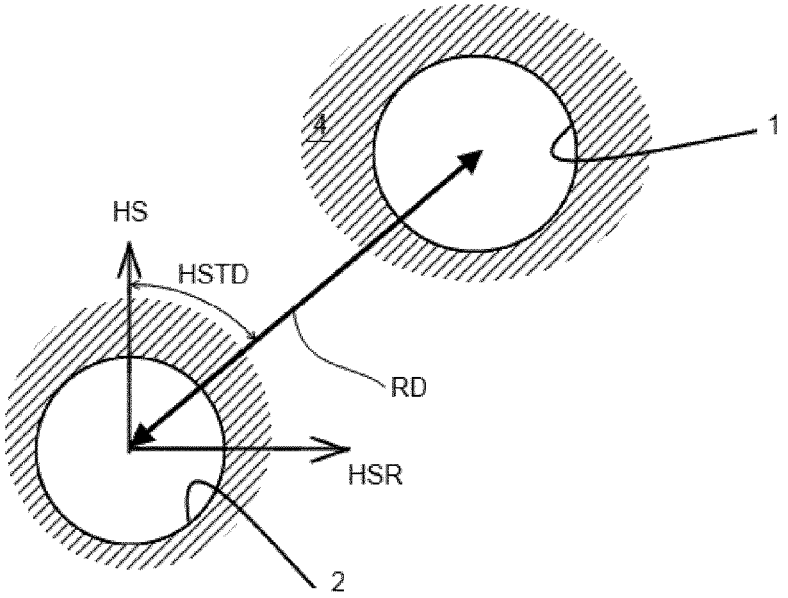
Figure 4:
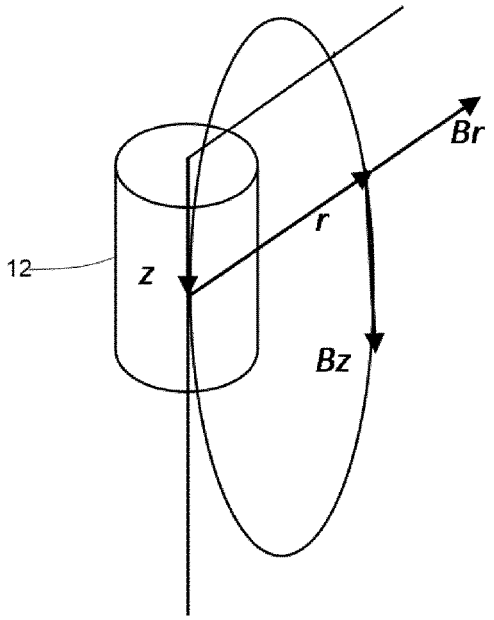
Figure 5:
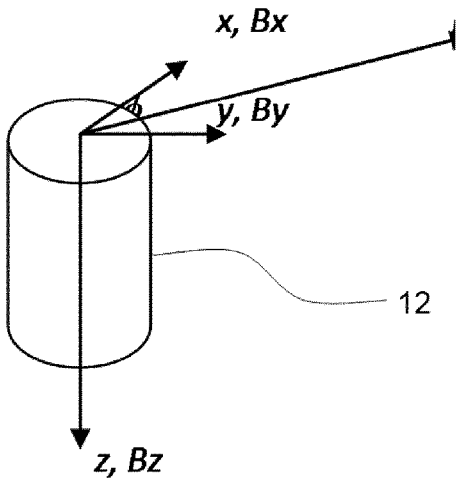
Figure 6:
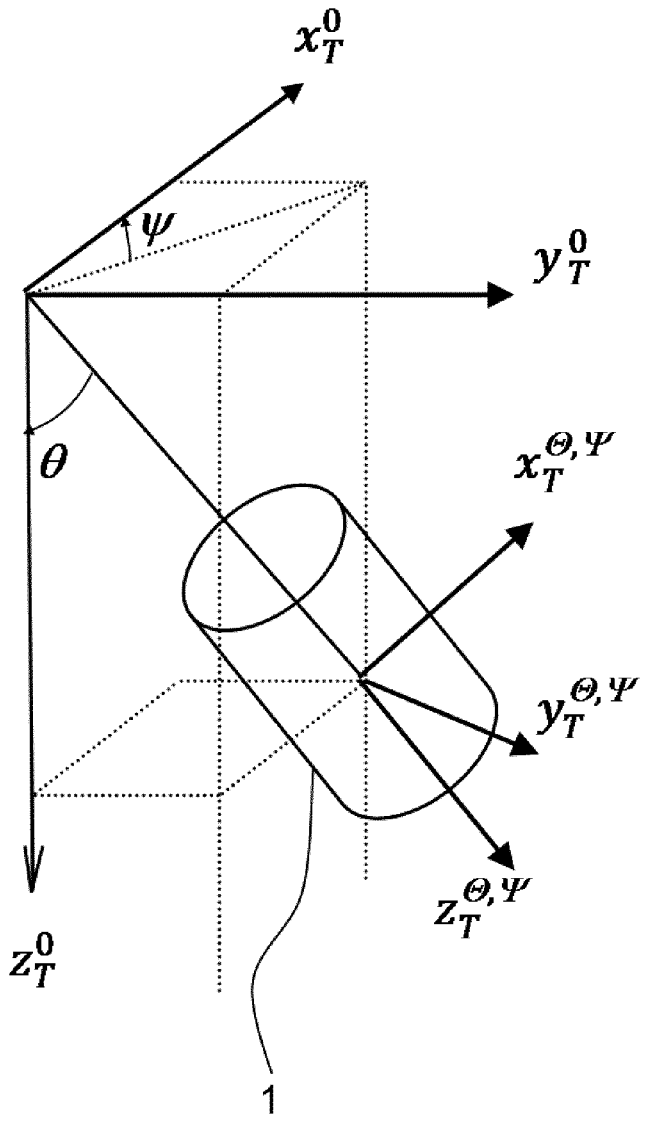
Figure 7:
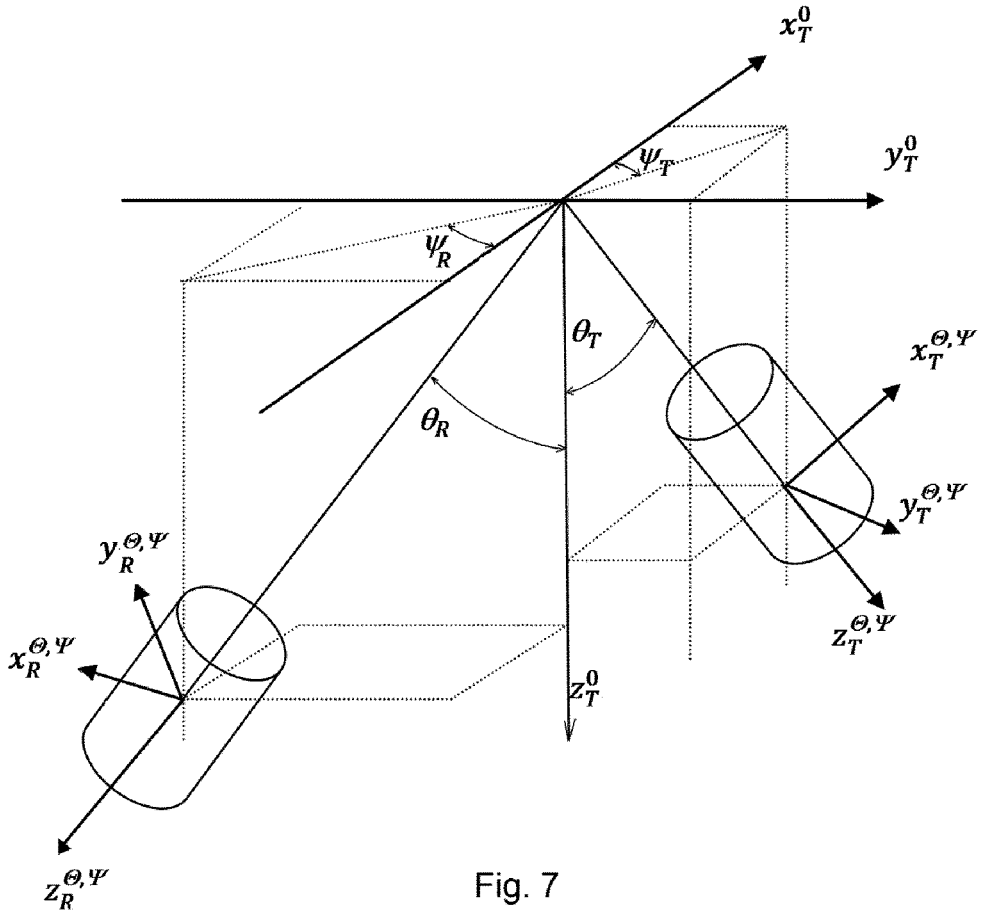
Figure 8:
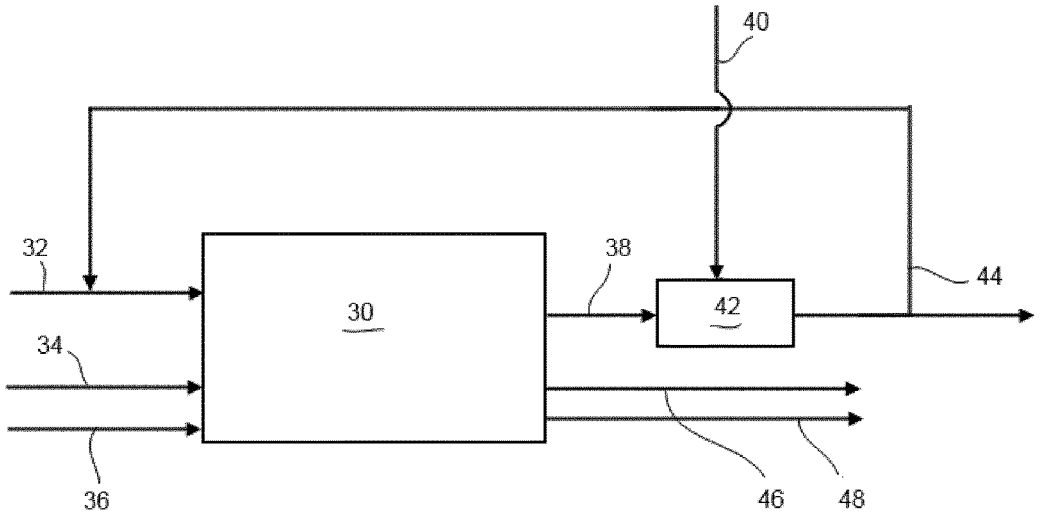

The invention will be described hereinafter in more detail and by way of example, with reference to the accompanying drawings in which:

FIG. 1 shows a cross section of a first borehole and a second borehole extending into an earth formation;

FIG. 2 schematically shows a magnetized casing to be arranged in the first wellbore;

FIG. 3 schematically shows a cross-section of the first and second wellbores; and FIG. 4 schematically shows a vertically oriented casing and a related polar coordinate system;

FIG. 5 schematically shows the vertically oriented casing and a related Cartesian coordinate system;

FIG. 6 schematically shows a target well oriented at an inclination angle and an azimuth angle;

FIG. 7 schematically shows the target well and a relief well oriented at respective inclination angles and azimuth angles; and FIG. 8 schematically shows a flow scheme of an exemplary method of steering the relief well in the direction of the target well.

In the drawings and the description, like reference numerals relate to like components.

Referring to FIG. 1 there is shown a first borehole 1 and a second borehole 2 extending into an earth formation 4. The first borehole is a wellbore 1 for the production of hydrocarbon fluid, and extends from a drilling rig 6 at surface to a reservoir zone 8 of the earth formation 4. A thick subsurface salt layer 10 overlays the reservoir zone 8. Hereinafter, the wellbore 1 is also referred to as the target well 1. The target well 1 is provided with a casing 11 which extends through a major portion of the salt layer, and a lower casing 12 which extends below the casing 11 and into the reservoir zone 8. The casing 12 is formed of a plurality of magnetized casing sections 14 so that the magnetized casing 12 induces a static magnetic field in the earth formation surrounding the casing 12. An annular device comprising a magnetometer 13 is arranged below the drill floor (not shown) of the drilling rig 6 in a manner allowing the magnetized casing 12 to pass through the annular device and to measure the magnetic field during lowering of the casing 12 into the target well 1. A drill string 16 with a drill bit 18 at its lower end extends from the drilling 6 via the casings 11, 12 into an open-hole lower section 20 of the target well 1. The target well 1 is S-shaped so that the open-hole section 20 is horizontally displaced from the drilling rig 6.

The second borehole is a relief well 2 passing from a drilling rig 22 at surface through the salt layer 10, and directed to intersect the target well 1 at the open-hole section 20 thereof. The drilling rig 22 is positioned at some horizontal distance from the drilling rig 6 so that the relief well 2 extends substantially vertically or slightly inclined. A drill string 24 with a drill bit 26 at its lower end extends from the drilling 22 into the relief well 2. The drill string 24 is furthermore provided with a measurement-while-drilling (MWD) tool 28 including a magnetometer device for measuring the components of the static magnetic field in a three-dimensional coordinate system.

Referring further to FIG. 2 there is shown the casing 12 with casing sections 14. Each casing section 14 has been magnetized so as to have axially spaced magnetic poles whereby a magnetic north pole is located at one end part of the casing section, and a magnetic south pole is located at the other end part of the casing section. Furthermore, the casing sections 14 are made-up in a sequence so that a discrete pattern of magnetic poles is obtained whereby at selected axial positions of the casing magnetic poles of similar polarity are adjacent each other in order to strengthen the magnetic field. In FIG. 2 the axial position of each magnetic north pole is indicated by a + sign, and the axial position of each magnetic South Pole is indicated by a − sign.

Referring further to FIG. 3 there is shown a cross-sectional view of the target well 1 and the relief well 2 whereby the high-side (HS) direction and the high-side-right (HSR) direction of the relief well are indicated. The HS direction of the borehole 1, 2 is defined by the intersection of a cross-sectional plane of the borehole 1, 2 and a vertical plane through the centre of the borehole 1, 2, and extends in upward direction. The HSR direction extends in the cross-sectional plane of the borehole 1, 2 and perpendicular to the HS direction. FIG. 3 furthermore shows the high-side-to-target (HSTD) direction which is defined by the angle between the HS direction and the direction from the centre of the relief well 2 to the centre of the target well 1, measured in the cross-sectional plane. Also, FIG. 3 shows the relative distance (RD) between the centre of the relief well 2 and the centre of the target well 1, measured in the cross-sectional plane.

Referring further to FIG. 4 there is shown a vertically oriented portion of casing 12 at the drilling rig 6 during running-in into the wellbore 1. The magnetic field induced by the casing 12 is rotationally symmetric relative to the central longitudinal axis of the casing. In view thereof the magnetic field can be characterized by a polar coordinate system having r- and z-axes whereby the z-axis extends vertically and the r-axis extends radially outward from the z-axis. In this polar coordinate system the magnetic field induced by the vertically oriented casing has a vertical component Bz and a radial component Br.

Referring further to FIG. 5 there is shown the vertically oriented portion of casing 12 whereby the magnetic field is characterized by a Cartesian coordinate system having horizontally oriented x- and y-axes, and a vertically oriented z-axis. In the Cartesian coordinate system, the magnetic field induced by the vertically oriented casing has a vertical component Bz and horizontal components Bx and By.

Referring further to FIG. 6 there is shown a portion of the target well 1 oriented at an inclination angle $\theta_T$ and an azimuth angle $\psi_T$. Furthermore there is shown a Cartesian coordinate system $x_T^0$, $y_T^0$, $z_T^0$ which is similar to the x, y, and z coordinate system referred to hereinbefore, however with the additional feature that the x-axis extends in North direction and the y-axis extends in East direction. Also there is shown a Cartesian coordinate system $x_T^{\theta\psi}$, $y_T^{\theta\psi}$, $z_T^{\theta\psi}$ of which the z-axis extends in axial direction of the target well, the x-axis extends in the HS direction of the target well, and the y-axis extends in the HSR direction of the target well. The subscript T refers to target well, the superscript 0 refers to a zero azimuth angle of the x-axis, and the superscript $\theta\psi$ refers to the orientation of the target well at inclination angle $\theta_T$ and azimuth angle $\psi_T$.

Referring further to FIG. 7 there is shown the portion of target well 1, the Cartesian coordinate system $x_T^0$, $y_T^0$, $z_T^0$ and the Cartesian coordinate system $x_T^{\theta\psi}$, $y_T^{\theta\psi}$, $z_T^{\theta\psi}$. FIG. 7 also shows a portion of relief well 2 oriented at an inclination angle $\theta_R$ and an azimuth angle $\psi_R$, together with a Cartesian coordinate system $x_T^{\theta\psi}$, $y_T^{\theta\psi}$, $z_T^{\theta\psi}$ of which the z-axis extends in axial direction of the relief well 2, the x-axis extends in the HS direction of the relief well, and the y-axis extends in the HSR direction of the relief well. The subscript R refers to the relief well, and the superscript $\theta\psi$ refers to the orientation of the relief well at inclination angle $\theta_R$ and azimuth angle $\psi_R$.

Referring further to FIG. 8 there is shown a flow scheme of a method to steer the relief well 2 in the direction of the target well 1, in which:

- item 30 indicates a finite element model of the static magnetic field induced by casing 12;
- item 32 indicates a position parameter representing the position of the target well at surface;
- item 34 indicates the magnetic field components measured with magnetometer 13 during lowering of casing 12 into the wellbore 1, expressed in the polar z-, r-coordinate system;
- item 36 indicates the inclination angles and azimuth angles of the target well and the relief well as a function of along hole depth;
- item 38 indicates the computed magnetic field components in the relief well, expressed in the $x_R^{\theta\psi}$, $y_R^{\theta\psi}$, $z_R^{\theta\psi}$ coordinate system;
- item 40 indicates the measured magnetic field components in the relief well, expressed in the $x_R^{\theta\psi}$, $y_R^{\theta\psi}$, $z_R^{\theta\psi}$ coordinate system;
- item 42 indicates a difference between the computed magnetic field components in the relief well and the measured magnetic field components in the relief well;
- item 44 indicates an adjustment to the position parameter 32;
- item 46 indicates the calculated high-side-to-target (HSTD) direction from the relief well to the target well;
- item 48 indicates the relative distance (RD) between the relief well and the target well.

During normal operation the wellbore 1 is drilled from the drilling rig 6 using the drill string 16 whereby the wellbore 1 passes through the salt layer 10 and into the reservoir zone 8 containing hydrocarbon fluid. The wellbore 1 is cased with casing 11 in conventional manner as drilling of the wellbore proceeds. The lowermost casing installed in the wellbore 1 is the magnetized casing 12 which is passed through the annular device 13 during lowering into the wellbore 1. As the casing 12 passes through the annular device, the magnetometer 13 thereof measures the components Bz and Br of the magnetic field as a function of the axial position of the casing 12. The measured components are stored in a memory of a computer (not shown).

If during further drilling of the wellbore 1 an unintended control situation occurs, such as a blowout, it may be required to shut the wellbore 1 in. This can be achieved by pumping heavy wellbore fluid into a lower part of the wellbore 1 via relief well 2 that needs to be drilled so as to intersect the wellbore 1 at the lower part thereof. The relief well 2 is drilled from drilling rig 22 using drill string 24. In order to steer the relief well 2 in the direction of the target well 1 the following method is used.

At selected drilling intervals the magnetometer device 28 is operated order to measure the components 40 of the magnetic field in the coordinate system $x_R^{\theta\psi}$, $y_R^{\theta\psi}$, $z_R^{\theta\psi}$. Also, the components 38 of the magnetic field in the coordinate system $x_R^{\theta\psi}$, $y_R^{\theta\psi}$, $z_R^{\theta\psi}$ are calculated by the finite element program 30, whereby the position parameter 32 is used as input parameter for the calculation. The mathematical procedure to calculate the components 38 of the magnetic field in the coordinate system 4, $x_R^{\Theta\Psi}$, $y_R^{\Theta\Psi}$, $z_R^{\Theta\Psi}$ will be explained hereinafter in more detail. In a next step the measured components 40 of the magnetic field and the computed components 38 of the magnetic field are compared in order to determine the difference 42 (if any) between these components. Then, the difference 42 between the computed magnetic field components in the relief well and the measured magnetic field components in the relief well is used to determine an adjustment 44 to the position parameter 32. The components 38 of the magnetic field in the coordinate system $x_R^{\Theta\Psi}$, $y_R^{\Theta\Psi}$, $z_R^{\Theta\Psi}$ are then recalculated by the finite element program, whereby the adjusted position parameter 32 is used as input parameter. In a next step, the difference 42 between the computed magnetic field and the measured magnetic field is again determined. The calculation procedure with the finite element model 30 is then repeated until the difference 42 between the computed magnetic field components in the relief well and the measured magnetic field components in the relief well is smaller than a selected maximum. Once the difference 42 is smaller than the selected maximum, the computer system 30 calculates the high-side-to-target (HSTD) direction from the relief well to the target well and the relative distance (RD) between the relief well and the target well. The relief well 2 is then further steered in a direction dependent on the calculated HSTD and RD.

The mathematical procedure to calculate the components 38 of the magnetic field in the coordinate system $x_R^{\Theta\Psi}$, $y_R^{\Theta\Psi}$, $z_R^{\Theta\Psi}$ is outlined below. The magnetic field induced by the magnetized casing 12 is rotational symmetric relative to the longitudinal axis of the casing. In view thereof the magnetic field can be expressed in a polar coordinate system with axes z and r, wherein the z-axis extends in the longitudinal direction of the casing, and the r-axis extends radially outward from the casing.

The casing 12 is oriented vertically at the drilling rig 6 during measurement with magnetometer 13, therefore the z-axis extends vertically and the r-axis extends horizontally. Thus, the component Bz of the magnetic field is a vertical component and the component Br of the magnetic field is a horizontal component. The magnetic field can also be expressed as a vector: [r, z, Br, Bz]. The components of this vector are computed with the finite element method.

The magnetic field can also be expressed in a Cartesian coordinate system with x-, y- and z-axes. In this coordinate system the z-axis extends vertically, and the x- and y-axes extend horizontally. For ease of reference, the x-axis is taken in North direction and the y-axis in East direction, therefore the x, y, z coordinate system also is referred to as N, E, V coordinate system. However any other horizontal orientation of the x- and y-axes is feasible. Taking into account this coordinate system, the magnetic field is in vector notation: [x, y, z, Bx, By, Bz]. To transfer between the vertically oriented polar coordinate system and the vertically oriented Cartesian coordinate system, the following notation is used whereby the subscript T refers to the Cartesian coordinate system pertaining to the target well and the superscript 0 refers to the North direction of the x-axis.

$$\begin{bmatrix} x \\ y \\ z \end{bmatrix}_T^0 = [\Phi_T]\begin{bmatrix} r \\ z \end{bmatrix};$$

-continued $$\begin{bmatrix} Bx \\ By \\ Bz \end{bmatrix}_T^0 = [\Phi_T]\begin{bmatrix} Br \\ Bz \end{bmatrix}$$

in which:

$$\begin{bmatrix} x \\ y \\ z \end{bmatrix}_T^0$$

is the position vector expressed in the N, E, V coordinate system;

$[_z{}^r]$ is the position vector expressed in the polar coordinate system;

$$\begin{bmatrix} Bx \\ By \\ Bz \end{bmatrix}_T^0$$

is the magnetic field vector expressed in the N, E, V coordinate system;

$[_{Bz}{}^{Br}]$ is the magnetic field vector expressed in the polar coordinate system;

$$[\Phi_T] = \begin{bmatrix} \cos\phi_T & 0 \\ \sin\phi_T & 0 \\ 0 & 1 \end{bmatrix}$$

wherein $\theta_T$ is the angle between the radial field vector and the x-axis, also referred to as the Toolface angle.

The target well usually does not extend vertically, but rather extends at inclination angle $\theta_T$ and azimuth angle $\psi_T$, which angles may vary with depth. Therefore the coordinate system in which the radial magnetic symmetrical field is expressed, is rotated about the inclination angle $\theta_T$ and the azimuth angle $\psi_T$. The position vector, expressed in the rotated coordinate system of the target well, is referred to as:

$$\begin{bmatrix} x \\ y \\ z \end{bmatrix}_{Target\ Well}^{\Theta,\Psi}.$$

The rotations can be represented using the following matrices:

$$[\Theta_T] = \begin{bmatrix} \cos\theta_T & 0 & -\sin\theta_T \\ 0 & 1 & 0 \\ \sin\theta_T & 0 & \cos\theta_T \end{bmatrix}$$

$$[\Psi_T] = \begin{bmatrix} \cos\psi_T & \sin\psi_T & 0 \\ -\sin\psi_T & \cos\psi_T & 0 \\ 0 & 0 & 1 \end{bmatrix}$$

Using these matrices, the position vector in the rotated coordinate system of the target well is:

$$\begin{bmatrix} x \\ y \\ z \end{bmatrix}_{Target\ Well}^{\Theta,\Psi} = [\Theta_T][\Psi_T]\begin{bmatrix} x \\ y \\ z \end{bmatrix}_{Target\ Well}^{0}$$

Since the position vector $$\begin{bmatrix} x \\ y \\ z \end{bmatrix}_{Target\ Well}^{\Theta,\Psi}$$

is known from a target well survey, and the radial magnetic symmetrical field vector $$\begin{bmatrix} Bx \\ By \\ Bz \end{bmatrix}_{Target\ Well}^{0}$$

is known from the measurement during running-in of the casing, it is now feasible to transform $$\begin{bmatrix} Bx \\ By \\ Bz \end{bmatrix}_{Target\ Well}^{0}$$

into the coordinate system of the relief well, with the objective to model the HSTD and the RD as a function of along hole depth of the relief well. The procedure to perform this transformation is as follows.

$$\begin{bmatrix} x \\ y \\ z \end{bmatrix}_{Relief\ Well}^{\Theta,\Psi} = \begin{bmatrix} x \\ y \\ z \end{bmatrix}_{Target\ Well}^{\Theta,\Psi} = [\Theta_T][\Psi_T]\begin{bmatrix} x \\ y \\ z \end{bmatrix}_{Target\ Well}^{0},$$

Hence the $$\begin{bmatrix} Bx \\ By \\ Bz \end{bmatrix}_{Target\ Well}^{0} \text{ vector with } \begin{bmatrix} x \\ y \\ z \end{bmatrix}_{Relief\ Well}^{\Theta,\Psi}$$

coordinates of the relief well trajectory becomes:

$$\begin{bmatrix} Bx \\ By \\ Bz \end{bmatrix}_{Relief\ Well}^{\Theta,\Psi} = [\Theta_R][\Psi_R][\Psi_T]^{-1}[\Theta_T]^{-1}[\Phi_T]\begin{bmatrix} Br \\ Bz \end{bmatrix}$$

in which $$[\Theta_R] = \begin{bmatrix} \cos\theta_R & 0 & -\sin\theta_R \\ 0 & 1 & 0 \\ \sin\theta_R & 0 & \cos\theta_R \end{bmatrix}$$

-continued and $$[\Psi_R] = \begin{bmatrix} \cos\psi_R & \sin\psi_R & 0 \\ -\sin\psi_R & \cos\psi_R & 0 \\ 0 & 0 & 1 \end{bmatrix}.$$

It follows from $$\begin{bmatrix} Bx \\ By \\ Bz \end{bmatrix}_{Relief\ Well}^{\Theta,\Psi}$$

that the modelled HSTD is:

$$HSTD_{modelled} = \tan^{-1}\left\{\frac{By}{Bx}\right\},$$

The HSTD is also derived from the target well survey and the MWD tool measurements in the relief well, and is referred to as $HSTD_{measured}$. Due to survey errors in both the target well and the relief well, $HSTD_{modelled}$ may deviate from $HSTD_{measured}$. The horizontal surface coordinates of the target well are then adjusted to minimize the error between $HSTD_{measured}$ and $HSTD_{modelled}$. Once a minimal error is achieved, the RD between the two wells is computed.

It is to be understood that in applying the method and system of the invention, the magnetic field measurements in steps (b) and (d) should be corrected for magnetic fields that may originate from sources other than the magnetized borehole casing, such as the earth magnetic field and magnetized parts of the drill string.

The finite element method is powerful and simple for the rotationally symmetric magnetic field, as the problem is a two-dimensional problem whereby the magnetic field is calculated in the axial direction and the radial direction only. The trajectory of the target well is relatively straight since typical trajectory curves generally have a radius of much more than 100 m. Therefore as soon the magnetic field is detected in the second borehole, the relative distance and direction to the target well can be derived directly, i.e. by correcting for the local earth magnetic field vector.

In the detailed example described above, the magnetic field is generated by magnetized casing joints. Alternatively, the magnetic field can be generated by other suitable borehole elements such as, for example, one or more magnetized drill pipe sections.

The present invention is not limited to the embodiments described above, wherein various modifications are conceivable within the scope of the appended claims. Features of respective embodiments may for instance be combined.

The invention claimed is:

1. A method for creating a second borehole in an earth formation at a selected orientation relative to a first borehole, wherein a position parameter represents a position of the first borehole, the method comprising the steps of:

a) providing a borehole element that generates a magnetic field and is adapted to be arranged in the first borehole and lowering said borehole element from surface into the first borehole;

b) measuring at least one component of the magnetic field at a selected distance from the borehole element with a first magnetometer at surface during said lowering of the borehole element into the first borehole whereby the first magnetometer measures the at least one component of the magnetic field as a function of axial position of the borehole element;

c) installing the borehole element in the first borehole;

d) measuring the magnetic field in the second borehole using a second magnetometer;

e) providing a finite element model of the magnetic field using each component of the magnetic field measured in step (b) as a boundary condition for the finite element model;

f) calculating the magnetic field in the second borehole using the finite element model, and determining a difference between the calculated magnetic field in the second borehole and the measured magnetic field in the second borehole;

g) adjusting the position parameter to minimise said difference;

h) determining a selected direction dependent on the adjusted position parameter; and i) drilling the second borehole in the selected direction.

2. The method of claim 1, wherein the borehole element comprises a casing to be installed in the first borehole, and wherein step (a) comprises magnetizing the casing so that the magnetic field is a static magnetic field.

3. The method of claim 2, wherein the casing is formed of a plurality of casing joints, and wherein the step of magnetizing the casing comprises magnetizing each of the casing joints.

4. The method of claim 3, wherein each casing joint is magnetized to have magnetic poles mutually spaced in longitudinal direction of the casing joint.

5. The method of claim 3, wherein the casing includes first casing joints and second casing joints, the first and second casing joints having magnetic north poles and south poles, wherein the first casing joints and the second casing joints are interconnected so that magnetic poles of similar polarity are adjacent each other.

6. The method of claim 1, wherein step (b) comprises measuring each component of the magnetic field at said selected distance prior to installing the borehole element in the first borehole.

7. The method of claim 1, wherein the borehole element has a substantially tubular shape, wherein the step of measuring at least one component of the magnetic field includes:

measuring each component of the magnetic field using an annular device comprising the first magnetometer; and moving the borehole element in axial direction through the annular device.

8. The method of claim 7, wherein the annular device is arranged above the first borehole, and wherein the borehole element is lowered substantially vertically into the first borehole through the annular device.

9. The method of claim 7, wherein the annular device is arranged at a drilling site used to drill the first borehole.

10. The method of claim 6, wherein each component of the magnetic field is measured at a plurality of axially spaced locations of the borehole element.

11. The method of claim 7, wherein the annular device is arranged at a relatively short radial distance with respect to the borehole element.

12. The method of claim 1, wherein the magnetic field is rotationally symmetric relative to a longitudinal axis of the borehole element, and wherein the finite element model is a two-dimensional model involving an axial direction of the borehole element and a radial direction of the borehole element.

13. The method of claim 1, wherein the step of measuring at least one component of the magnetic field comprises measuring a radial and/or axial component of the magnetic field.

14. The method of claim 1, wherein step (f) comprises calculating the magnetic field in a coordinate system characterized by an inclination angle and/or an azimuth angle of the second borehole.

15. The method of claim 14, wherein said calculation takes into account an inclination angle and/or an azimuth angle of the first borehole.

16. The method of claim 1, wherein the step of measuring the magnetic field comprises measuring the magnetic field using an electronic multi shot system.

17. The method of claim 1, wherein step (h) comprises determining a high-side-to-target direction from the second borehole to the first borehole.

18. The method of claim 1, wherein step (h) comprises determining a relative distance between the second borehole and the first borehole.

19. The method of claim 1, wherein said position parameter representing a position of the first borehole comprises a horizontal position of the first borehole at surface.

20. The method of claim 1, wherein step (h) comprises using the adjusted position parameter to update the finite element model of the magnetic field.

21. The method of claim 1, wherein the first borehole extends through a salt layer of the earth formation.

22. The method of claim 1, wherein the first borehole is a hydrocarbon well subjected to a blowout, and the second borehole is a relief well drilled to intersect the hydrocarbon well.

23. The method of claim 1, wherein in at least one of steps (b) and (d) the measurement result is corrected for magnetic interference from a source other than the borehole element.

24. A system for creating a second borehole in an earth formation at a selected orientation relative to a first borehole formed in the earth formation, wherein a position parameter represents a position of the first borehole, the system comprising:

a borehole element that generates a magnetic field and is adapted to be arranged in the first borehole;

a device for measuring at least one component of the magnetic field at a selected distance from the borehole element, said device comprising a first magnetometer arranged above the first borehole in a manner wherein the device measures said at least one component of the magnetic field during lowering of the borehole element into the first borehole;

installation means for installing the borehole element in the first borehole;

a second magnetometer means for measuring the magnetic field in the second borehole;

a finite element model of the magnetic field wherein said at least one component of the magnetic field is used as a boundary condition for the finite element model;

calculating means for calculating the magnetic field in the second borehole using the finite element model, for determining a difference between the calculated magnetic field in the second borehole and the measured magnetic field in the second borehole, for adjusting the position parameter so as to minimise said difference, and for determining a selected direction dependent on the adjusted position parameter; and a drilling device for drilling the second borehole in the selected direction.

25. The system of claim 24, wherein the first magnetometer arranged above the first borehole comprises an annular device through which the borehole element passes while lowering of the borehole element into the first borehole.

* * * * *